US008879690B2

(12) United States Patent
Chaki et al.

(10) Patent No.: US 8,879,690 B2
(45) Date of Patent: Nov. 4, 2014

(54) X-RAY GENERATOR

(75) Inventors: Tomohiro Chaki, Tachikawa (JP); Koichi Kato, Hamura (JP); Masahiro Nonoguchi, Tachikawa (JP); Masashi Kageyama, Ome (JP); Masaru Kuribayashi, Akishima (JP)

(73) Assignee: Rigaku Corporation, Akishima-Shi, Tokyo (JP)

( * ) Notice: Subject to any disclaimer, the term of this patent is extended or adjusted under 35 U.S.C. 154(b) by 385 days.

(21) Appl. No.: 13/337,940

(22) Filed: Dec. 27, 2011

(65) Prior Publication Data

US 2012/0163550 A1 Jun. 28, 2012

(30) Foreign Application Priority Data

Dec. 28, 2010 (JP) ..... 2010-292602
Dec. 28, 2010 (JP) ..... 2010-292603

(51) Int. Cl.

| | |
|---|---|
| ***H01J 35/06*** | (2006.01) |
| ***H01J 35/14*** | (2006.01) |
| ***H01J 35/16*** | (2006.01) |
| ***H01J 29/02*** | (2006.01) |
| ***H01J 29/04*** | (2006.01) |
| ***H01J 35/10*** | (2006.01) |

(52) U.S. Cl.

CPC ..... *H01J 35/10* (2013.01); *H01J 2235/168* (2013.01); *H01J 35/06* (2013.01); *H01J 2235/086* (2013.01); *H01J 2235/06* (2013.01); *H01J 2235/166* (2013.01); *H01J 35/14* (2013.01); *H01J 35/16* (2013.01)

USPC ..... 378/136; 378/137; 378/138; 250/503.1; 250/522.1

(58) Field of Classification Search

CPC ..... H01J 35/00; H01J 35/02; H01J 35/06; H01J 3/02; H01J 3/027; H01J 19/02; H01J 19/08; H01J 19/10; H01J 19/12; H01J 19/42; H01J 19/44; H01J 19/46; H01J 19/48; H01J 19/50; H01J 29/04; H01J 29/46; H01J 29/48; H01J 29/485; H01J 29/487; H05G 1/02; H05G 1/08

USPC ..... 378/119, 121, 136–138, 193, 204, 210; 250/493.1, 503.1, 505.1, 522.1, 526

See application file for complete search history.

(56) References Cited

U.S. PATENT DOCUMENTS 3,143,679 A * 8/1964 Stansfield ..... 378/136
5,224,142 A 6/1993 Ono et al.

(Continued)

FOREIGN PATENT DOCUMENTS

JP 05-013030 1/1993
JP 2003-014895 A 1/2003

(Continued)

*Primary Examiner* — Anastasia Midkiff
(74) *Attorney, Agent, or Firm* — Buchanan Ingersoll & Rooney PC

(57) ABSTRACT

Provided is an X-ray generator for generating X-rays from an X-ray focal point that is a region in which electrons emitted from a filament impinge upon a rotating anode. The X-ray generator has a Wehnelt electrode for surrounding the filament, an attachment part formed integrally with the Wehnelt electrode, a pedestal to which the attachment part is attached, and a casing for housing the pedestal and the anticathode. The width of the space in which the anticathode is housed by the casing is less than the width of the space in which the pedestal is housed by the casing. The Wehnelt electrode extends into the space in which the anticathode is housed by the casing, in a state in which the attachment part is attached to the pedestal.

8 Claims, 10 Drawing Sheets

(56) References Cited

U.S. PATENT DOCUMENTS

| | | | |
|---|---|---|---|
| 6,823,042 | B2 | 11/2004 | Hayashi et al. |
| 7,352,846 | B2 | 4/2008 | Kuribayashi et al. |
| 2012/0207279 | A1 | 8/2012 | Shimono |

FOREIGN PATENT DOCUMENTS

| | | | |
|---|---|---|---|
| JP | 2007-115553 | A | 5/2007 |
| JP | 2011-096572 | A | 5/2011 |

* cited by examiner

X-RAY GENERATOR

BACKGROUND OF THE INVENTION

1. Field of the Invention

The present invention relates to an X-ray generator for generating X-rays from an anticathode by causing electrons generated from a cathode to impinge upon the anticathode.

2. Description of the Related Art

The above-mentioned X-ray generator is a device for generating X-rays which are irradiated to a sample to be analyzed in an X-ray diffraction device, for example. The device disclosed in Japanese Laid-open Patent Publication No. 2003-014895 (Patent Citation 1 ), is known as an example of this type of X-ray generator. As shown in FIG. 7, this X-ray generator has an electron gun 52 which houses a filament 51 as the cathode, and a rotating anode 53 which is provided opposite the filament 51. The electron gun 52 is formed in the shape of a flat rectangular solid, as shown in the partial magnified view of FIG. 7A. An electron gun in the shape of a flat rectangular solid is also disclosed in Japanese Laid-open Patent Publication No. 2007-115553 (Patent Citation 2 ), for example.

A housing 54 that gives the electron gun 52 the rectangular solid shape thereof also serves as a conductive Wehnelt electrode. An aperture 55 as a region for passing the electrons generated from the filament 51 is provided to the conductive Wehnelt electrode in the portion opposite the filament 51. The electron gun 52 and the rotating anode 53 are provided inside a casing 57. The inside of the casing 57 is kept hermetically sealed in a vacuum state.

The casing 57 is grounded, the filament 51 has a potential of −60 kV, for example, and the Wehnelt electrode 54 has a potential several hundred volts different from the filament 51. Electrons (thermo electrons) generated from the filament 51 as a result of applying electrical power impinge upon a surface of the rotating anode 53 at the high voltage described above. The region on which the electrons impinge in this manner is an X-ray focal point F. X-rays R0 are generated from this X-ray focal point F. The X-rays R0 are extracted to the outside via an X-ray extraction window 56 formed of beryllium or the like in an appropriate location of the wall of the casing 57.

SUMMARY OF THE INVENTION

In FIG. 7, the dimensions of each part of the conventional X-ray generator are as shown below.

Width W0 of the electron gun 52: 30 mm

Width W1 of the rotating anode 53: 20 mm

Distance W2 between the electron gun 52 and the inside surface of the wall of the casing 57: 15 mm Distance W3 from a center line X2 extending in the plane-parallel direction of the rotating anode 53 (direction at a right angle to the width direction) to an outside surface of the wall of the casing 57: 55 mm Distance W4 from the center line X2 extending in the plane-parallel direction of the rotating anode 53 to a distal end of an X-ray conditioning element (e.g., an X-ray conditioning structure such as a monochromator, an X-ray focusing mirror, or the like) 59: 60 mm The electron gun 52 is a consumable item, and must be replaced with another electron gun 52 as needed. The electron gun 52 must sometimes be replaced with another type of electron gun according to the type of measurement. During this replacement, a cover 58 provided in a position near the electron gun 52 is removed from the wall of the casing 57, the electron gun 52 is removed from a pedestal 60, and another electron gun 52 is subsequently attached to the pedestal 60. The electron gun width W0 and the electron gun gap W2 described above are set so as to allow such replacement of the electron gun to be performed manually.

However, in the conventional X-ray generator having a shape and dimensions such as described above, a large installation distance W4 of about 60 mm is required for the X-ray conditioning element 59. In general, as the distance from the X-ray focal point F to the X-ray conditioning element 59 increases, the angle of the X-rays exiting the X-ray focal point F that can be captured by the X-ray conditioning element 59 decreases. A problem therefore arises in that a large portion of the X-rays generated from the X-ray focal point F cannot be effectively utilized. In other words, a problem arises in that the efficiency of X-ray focusing by the X-ray conditioning element 59 cannot be maintained at a high level.

On the other hand, when the installation distance W4 of the X-ray conditioning element 59 is reduced, since specialized tools are needed to attach and detach the electron gun 52 inside the casing 57, maintenance must be performed by the manufacturer of the X-ray generator, which is extremely inconvenient.

The present invention was developed in view of the problems of the prior art described above, and an object of the present invention is to provide an X-ray generator whereby X-ray focusing efficiency of an X-ray conditioning element such as a monochromator can be enhanced without hindering the manual replacement of the electron gun.

The X-ray generator according to the present invention is an X-ray generator for generating X-rays from an X-ray focal point which is a region in which electrons emitted from a cathode impinge upon an anticathode; the X-ray generator comprising a Wehnelt electrode for surrounding the cathode; an attachment part formed integrally with the Wehnelt electrode; a pedestal to which the attachment part is attached; and a casing for housing the pedestal and the anticathode; wherein the width of an anticathode housing space in which the anticathode is housed by the casing is less than the width of a pedestal housing space in which the pedestal is housed by the casing; and the Wehnelt electrode extends into a space in which the anticathode is housed by the casing, in a state in which the attachment part is attached to the pedestal.

Through the present invention, since the width of the space (anticathode housing space) in which the anticathode is housed by the casing is less than the width of the space (pedestal housing space) in which the pedestal is housed by the casing, the width of the pedestal housing space can be made less than the width of the anticathode housing space even in a case in which the width of the pedestal housing space is set relatively large so as to pose no impediment to manual replacement of the electron gun.

By reducing the width of the anticathode housing space of the casing in this manner, in a case in which an X-ray conditioning element (e.g., a monochromator, X-ray focusing mirror, or the like) is disposed outside the casing, it is possible to reduce the distance from a center line (i.e., the center line of the anticathode passing through the X-ray focal point) in the plane-parallel direction of the anticathode to the X-ray conditioning element. Reducing the distance from the X-ray focal point to the X-ray conditioning element makes it possible to increase the range of capture angles of X-rays emitted from the X-ray focal point that are captured by the X-ray conditioning element, and the range of capture lengths of X-rays that correspond to the capture angles, and the efficiency of X-ray focusing by the X-ray conditioning element can therefore be increased.

Furthermore, since the distance from the X-ray focal point to the X-ray conditioning element is reduced, attenuation of the intensity of X-rays due to air scattering can also be suppressed.

Preferably, in the X-ray generator according to the present invention, the width of the Wehnelt electrode is less than the width of the attachment part. The width of the attachment part of the electron gun can thereby be kept large despite the reduction in width of the Wehnelt electrode, and adverse effects on the workability of electron gun replacement can therefore be prevented.

The X-ray generator according to the present invention may further comprise an X-ray extraction window provided to the casing for housing the anticathode. The distance from a center line in the plane-parallel direction of the anticathode to the X-ray extraction window may be set so as to be less than the distance from the center line in the plane-parallel direction of the anticathode to an inside surface of a portion of the casing that houses the pedestal. Through this configuration, the distance between the X-ray conditioning element disposed outside the X-ray extraction window and the X-ray focal point on the anticathode can be reduced while ease of attachment and detachment of the electron gun with respect to the pedestal is ensured.

Through the present invention, since the width of the anticathode housing space of the casing is less than the width of the pedestal housing space of the casing, the width of the pedestal housing space can be made less than the width of the anticathode housing space even in a case in which the width of the pedestal housing space is set relatively large so as to pose no impediment to manual replacement of the electron gun.

By reducing the width of the anticathode housing space of the casing in this manner, in a case in which an X-ray conditioning element (e.g., a monochromator, X-ray focusing mirror, or the like) is disposed outside the casing, it is possible to reduce the distance from a center line (i.e., the center line of the anticathode passing through the X-ray focal point) in the plane-parallel direction of the anticathode to the X-ray conditioning element. Reducing the distance from the X-ray focal point to the X-ray conditioning element makes it possible to increase the range of capture angles of X-rays emitted from the X-ray focal point that are captured by the X-ray conditioning element, and the range of capture lengths of X-rays that correspond to the capture angles, and the efficiency of X-ray focusing by the X-ray conditioning element can therefore be increased.

BRIEF DESCRIPTION OF THE DRAWINGS

FIGS. 7 and 7A are sectional plan views showing an example of the conventional X-ray generator;

DESCRIPTION OF THE PREFERRED EMBODIMENTS (First Embodiment of the X-ray Generator)

The X-ray generator of the present invention will be described based on embodiments. The present invention is, of course, not limited to these embodiments. The drawings are referred to in the following description, but constituent elements are sometimes shown at a scale other than the actual scale thereof in order to facilitate understanding of characteristic portions.

Figure 1:
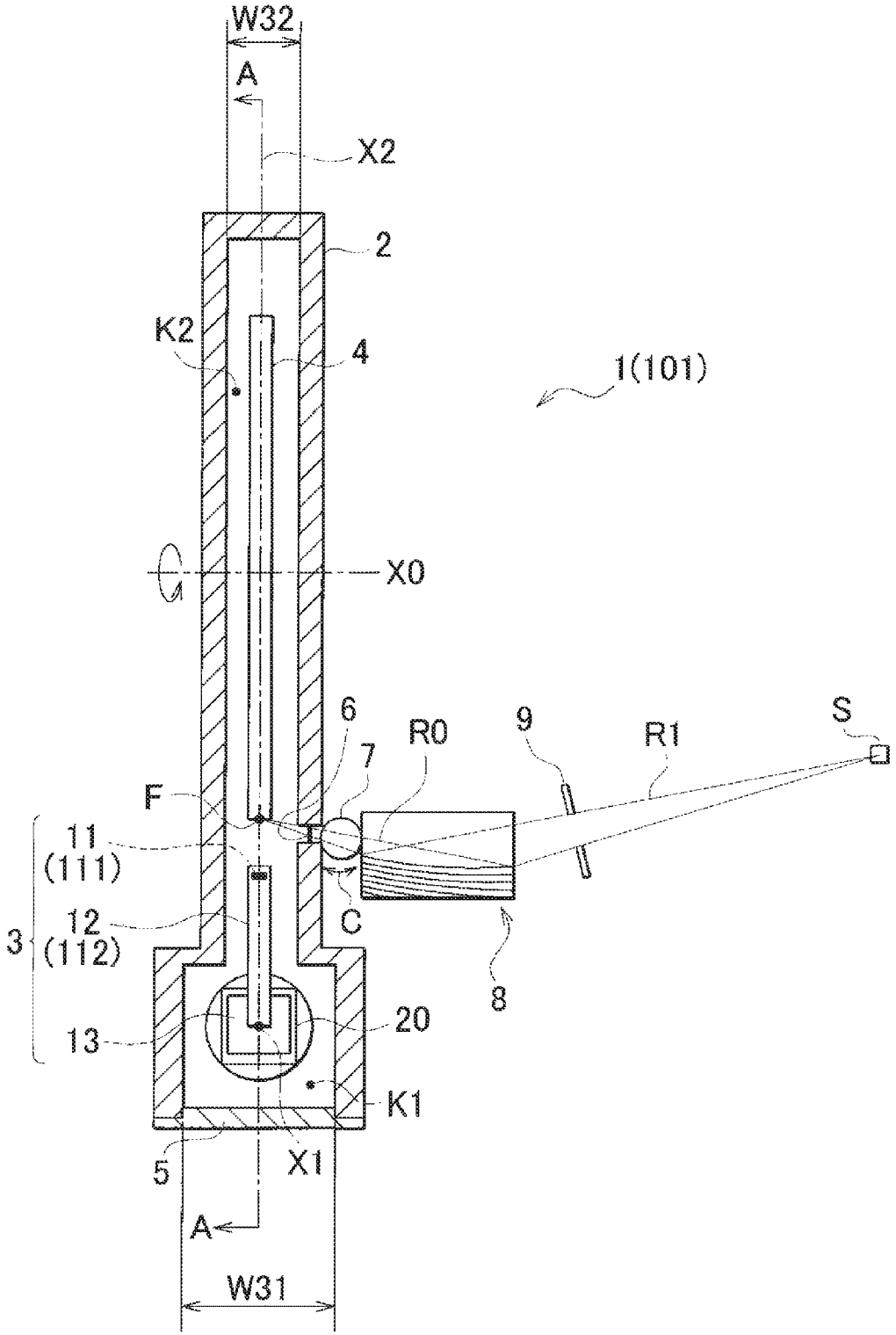
FIG. 1 is a sectional plan view showing an embodiment of the X-ray generator according to the present invention.
Figure 2:
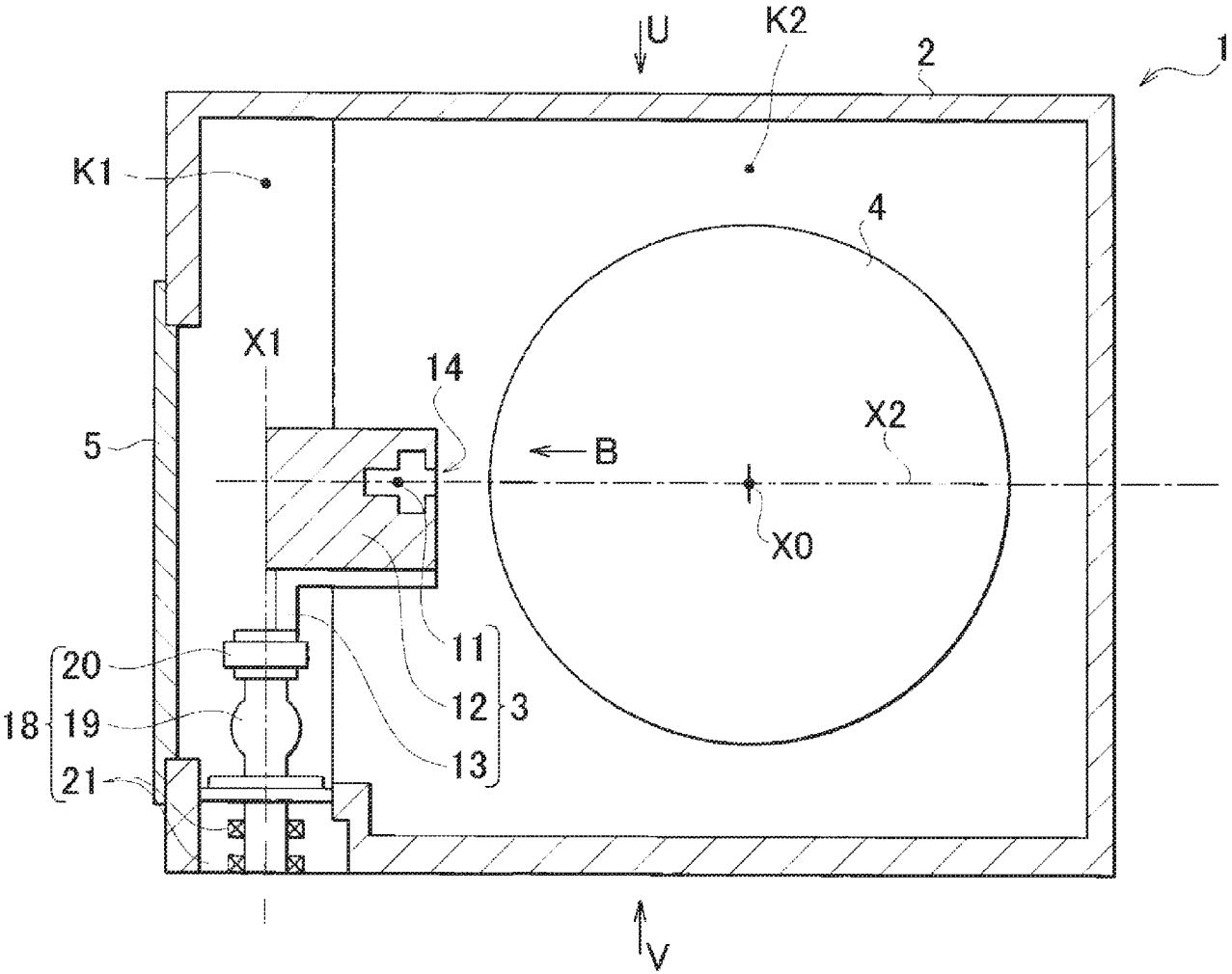
FIG. 2 is a sectional side view showing the X-ray generator along line A-A of FIG. 1.
Figure 3:
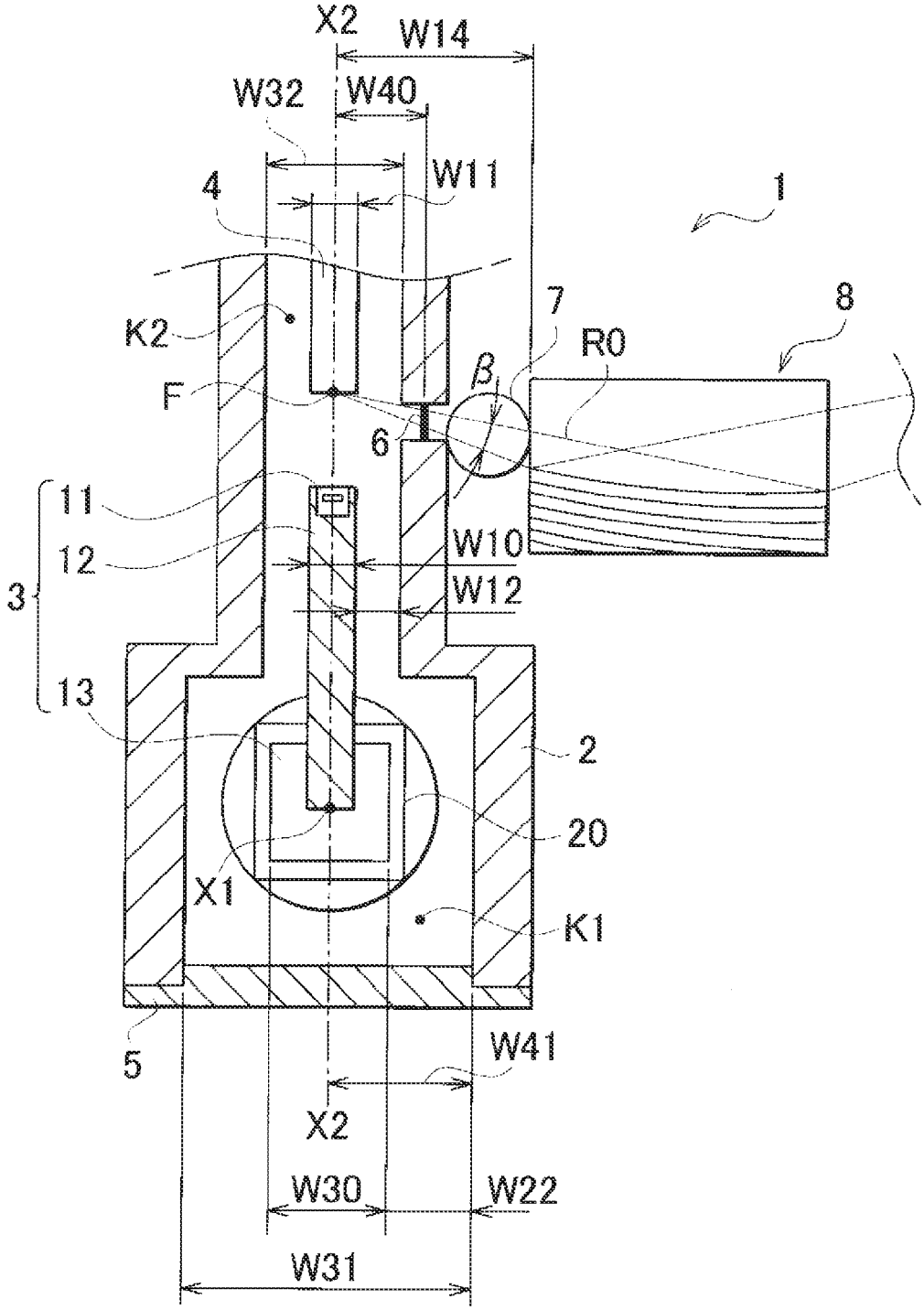
FIG. 3 is an enlarged sectional view showing the main parts of the X-ray generator shown in FIG. 1.

FIG. 1 is a sectional plan view showing an embodiment of the X-ray generator according to the present invention. FIG. 2 is a sectional side view showing the X-ray generator along line A-A of FIG. 1. FIG. 3 is an enlarged view showing the electron gun and the area surrounding the electron gun, which is a main part in FIG. 1.

In these drawings, an X-ray generator 1 has a metal casing 2, an electron gun 3 provided inside the casing 2, and a rotating anode 4 provided opposite the electron gun 3. An X-ray extraction window 6 is provided in a portion of a wall of the casing 2 at a portion thereof where the electron gun 3 and the rotating anode 4 face each other. The X-ray extraction window 6 is formed of a material, e.g., Be (beryllium), that is capable of passing X-rays.

An end part of the casing 2 on the side thereof on which the electron gun 3 is provided forms an aperture of sufficient size to allow the electron gun 3 (i.e., a Wehnelt electrode 12 and an attachment part 13 integrated therewith, described hereinafter) to be taken in and out. The aperture is closed by a cover 5. The cover 5 can be attached to and detached from the casing 2 by a screw or other fastening means.

FIG. 1 shows an example in which the X-ray extraction window 6 is provided in the right-side wall (wall on the near side not shown in FIG. 2) of the casing 2, but the X-ray extraction window 6 may also be provided in the left-side wall (wall on the far side in FIG. 2) of the casing 2 shown in FIG. 1. The X-ray extraction window 6 may also be provided in the near side and/or the far side (i.e., the upper side U and/or the lower side V of the X-ray generator 1 shown in FIG. 2).

The X-ray generator 1 also has an X-ray shutter 7 provided near the outer part of the X-ray extraction window 6, a monochromator 8 provided with light-focusing capability as an X-ray conditioning element provided at the rear (right-side part in FIG. 1) of the X-ray shutter 7, and a slit 9 for blocking the progress of unnecessary X-rays. The X-ray extraction window 6 has an irradiation angle wider than the range angles β (refer to FIG. 3) at which the monochromator 8 captures the X-rays generated from the X-ray focal point F. An X-ray conditioning structure other than a monochromator may also be used as the X-ray conditioning element.

In a case in which the X-ray generator 1 is applied in an X-ray measurement device, i.e., an X-ray analyzer, the X-rays that pass through the slit 9 irradiate an extremely small region of a sample S (e.g., a protein), e.g., a region within the range of 50×50 μm to 150×150 μm. In the case that diffraction occurs in the sample S, the diffracted rays are detected by an X-ray detector not shown in the drawings. The X-ray measurement device is not limited to a specific configuration, and the present invention may be applied in a device for measuring diffraction by a focusing method, a device for measurement diffraction by a parallel beam method, and various other types of X-ray measurement devices.

As shown in FIGS. 2 and 3, the electron gun 3 has a filament 11 as a cathode, a Wehnelt electrode 12 for surrounding the filament 11, and an attachment part 13 which is formed integrally with the Wehnelt electrode. In the present embodiment, the entire Wehnelt electrode 12 is formed of a single metal material. However, the Wehnelt electrode 12 may also be formed by a plurality of parts as needed.

Figure 4:
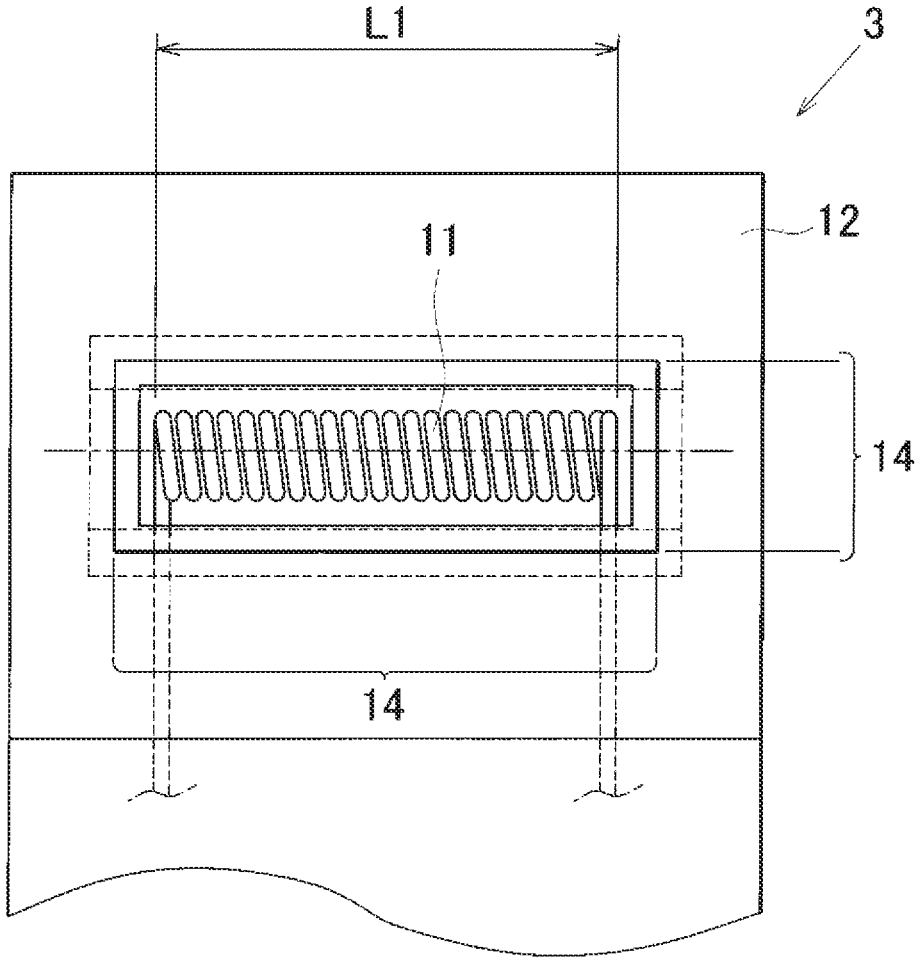
FIG. 4 is a view showing the configuration of the front surface of the electron gun in the direction of arrow B in FIG. 2.

The filament 11 is formed of W (tungsten), for example. FIG. 4 shows a state in which the electron gun 3 is viewed from the front from the direction of arrow B in FIG. 2. The filament 11 is formed by a coil, i.e., a helical filament, of length L1. An aperture 14 for passing electrons is provided in front of the filament 11.

As is apparent from FIGS. 1 and 2, the rotating anode 4 is formed in a disc shape. The outer circumferential surface of the rotating anode 4 is formed of a material capable of generating X-rays of the desired wavelength. In the case that CuKα rays are desired, for example, the rotating anode 4 is formed of Cu (copper).

The combination of the filament and the anticathode is not limited to a combination of tungsten and copper. For example, the filament may be obtained by forming rod-shaped or plate-shaped $LaB_6$ (lanthanum hexaboride) having a rectangular cross-sectional shape into an appropriate apparent shape, rather than being composed of coiled tungsten. The anticathode may also be Cr (Chromium) or W (tungsten).

The rotating anode 4 is driven by a drive device not shown in the drawings, and rotates about a center line X0 that extends in the width direction (i.e., the direction orthogonal to the circular plane) of the anticathode 4. The rotating anode 4 rotates at a rotation speed of 9,000 to 12,000 rpm, for example. Although not shown in the drawings, the drive device may be of any configuration, such as a belt-drive scheme in which a drive source and a center shaft of the rotating anode 4 are linked by a belt, or a direct-drive scheme in which a center shaft of the rotating anode 4 is directly driven in rotation by electromagnetic force, for example. The shape of the casing 2 may change in the case that a different drive method is employed, but in any case, a hermetic seal is maintained inside the casing 2.

Figure 5:
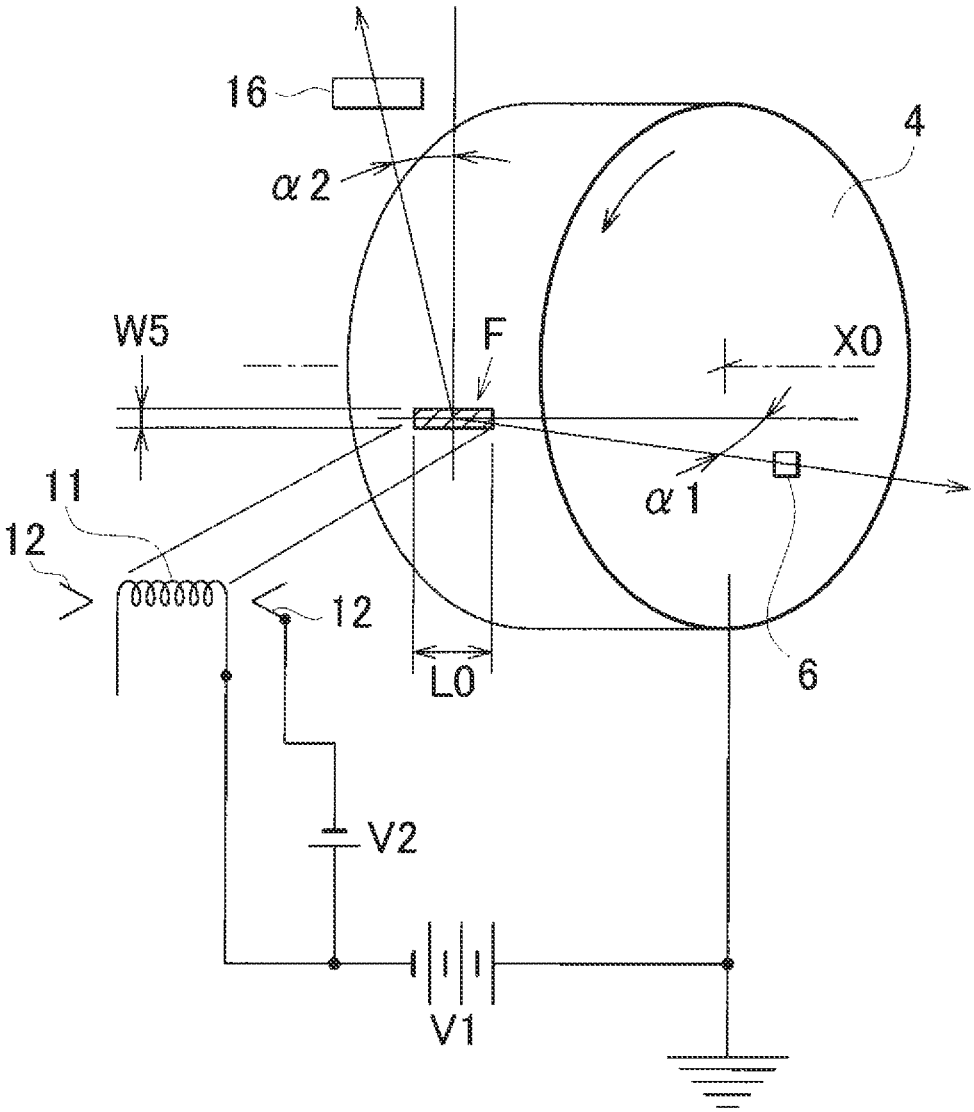
FIG. 5 is a view showing the manner in which X-rays are extracted from the rotating anode.

FIG. 5 is a schematic view zshowing the cathode filament 11 and the rotating anode 4. In FIG. 5, the rotating anode 4 is electrically grounded. A negative voltage V1, e.g., V1=45 to 60 kV, is applied between the rotating anode 4 and the filament 11. A negative voltage V2, e.g., V2=200 V, is applied between the filament 11 and the Wehnelt electrode 12. The filament 11 generates heat when power is applied thereto, and releases thermo electrons. The released electrons are accelerated by the voltage V1 while the progression direction thereof is controlled by the Wehnelt electrode 12, and the electrons impinge upon the outer circumferential surface of the rotating anode 4. The region in which electrons impinge upon the outer circumferential surface of the rotating anode 4 in this manner is the X-ray focal point F, and X-rays occur in all directions in space from this X-ray focal point F.

The actual X-ray focal point F formed on the outer circumferential surface of the rotating anode 4 is referred to as the real focus. The real focus F is rectangular, for example, with a width W5 and length L0 corresponding to the shape of the filament 11. The dimensions of the rectangle range from W5=40 μm and L0=400 μm to W5=70 μm and L0=700 μm.

The X-rays released in all directions from the X-ray focal point F are extracted to the outside from the extraction window 6 provided in the direction parallel to the rotational center line X0 of the rotating anode 4 (i.e., provided on a short side of the X-ray focal point F), and are extracted to the outside from an extraction window 16 provided in the direction at a right angle to the rotation center line X0 (i.e., provided on a long side of the X-ray focal point F). The angle α1 of the extraction window 6 with respect to the X-ray focal point F, and the angle α2 of the extraction window 16 with respect to the X-ray focal point F are referred to as X-ray extraction angles, and these angles are 5° to 6°, for example. The X-ray extraction window 6 is the same as the X-ray extraction window 6 shown in FIG. 1. The X-ray extraction window 16 is not provided in the present embodiment shown in FIG. 1.

The X-ray focal point for the X-rays extracted from the window 6 on the short side of the real focus F, and the X-ray focal point for the X-rays extracted from the window 16 on the long side of the real focus F are referred to as effective foci. The effective focus of the X-rays extracted from the window 6 on the short side of the real focus F is a 40×40 μm rectangle or a circle with a diameter ϕ of 40 μm when the real focus is 40×400 μm. On the other hand, when the real focus is 70×700 μm, the effective focus is 70 by 70 μm or ϕ70 μm. The X-rays thus extracted are referred to as point focus X-rays.

The effective focus of the X-rays extracted from the window 16 on the long side of the real focus F is a 4×40 μm rectangle when the real focus is 40×400 μm. On the other hand, when the real focus is 70×700 μm, the effective focus is 7 by 700 μm. The X-rays thus extracted are referred to as line focus X-rays.

Point focus or line focus is selected for use as appropriate according to the type of measurement performed by an X-ray analysis device such as an X-ray diffractometer or an X-ray scattering apparatus. In the present embodiment, point focus X-rays are extracted from one X-ray extraction window 6 on a short side of the real focus F.

In FIGS. 1 and 2, the casing 2 has the function of maintaining a vacuum state on the inside thereof. The casing 2 is therefore equipped with an exhaust system provided with a turbo molecular pump and a rotary pump, or an exhaust system having any other configuration. However, the exhaust system is not shown in FIGS. 1 and 2. The shape of the casing 2 may change in the case that a different type of exhaust system is employed, but in any case, a hermetic seal is maintained inside the casing 2.

In FIG. 2, a support device 18 for the electron gun 3 is provided at an end part of the casing 2. The support device 18 has an insulator 19 formed of a ceramic, and a pedestal 20 which is fixed on the insulator 19. The attachment part 13 of the electron gun 3 is fixed on the pedestal 20 by a screw or other fixture. This fixing may also be accomplished by a fixing means other than a screw.

The insulator 19 is supported on the casing 2 by a bearing 21 so as to be able to rotate about a center line X1 of the insulator 19. The rotation center line X1 of the insulator 19, and thus of the pedestal 20, intersects with the center line X2 of the width direction of the rotating anode 4 orthogonal to the rotation center line X0 of the rotating anode 4. Specifically, the rotation center line X1 intersects with the center line X2 of the rotating anode 4 that extends in the direction parallel to the plane of the disc of the rotating anode 4.

The insulator 19 and the pedestal 20 fixed thereto can rotate about the center line X1, but are usually fixed in the position shown in FIG. 1, i.e., the position where the Wehnelt electrode 12 of the electron gun 3 is in a straight line with the rotating anode 4. The position in which the Wehnelt electrode 12 is in a straight line with the rotating anode 4 is the position in which the Wehnelt electrode 12 is mounted on the center line (i.e., center line of the width direction of the rotating anode 4) X2 extending in the plane-parallel direction of the rotating anode 4.

Removing the Wehnelt electrode 12 from the fixed state described above enables the pedestal 20 and the electron gun 3 attached thereto to be rotatably driven, i.e., tipped, at a small angle about the line X1. The pedestal 20 can then be fixed at the position reached after the tipping movement. The purpose of such tipping movement of the electron gun 3 is to vary the impingement region of electrons on the outer circumferential surface of the rotating anode 4, i.e., the formation region of the X-ray focal point F, on the outer circumferential surface of the rotating anode 4. For example, since the left-side portion and right-side portion from the center of the outer circumferential surface of the rotating anode 4 are formed of different materials, the wavelength of X-rays generated from the outer circumferential surface of the rotating anode 4 can be varied by tipping the electron gun 3 in the left-right direction.

Figure 6:
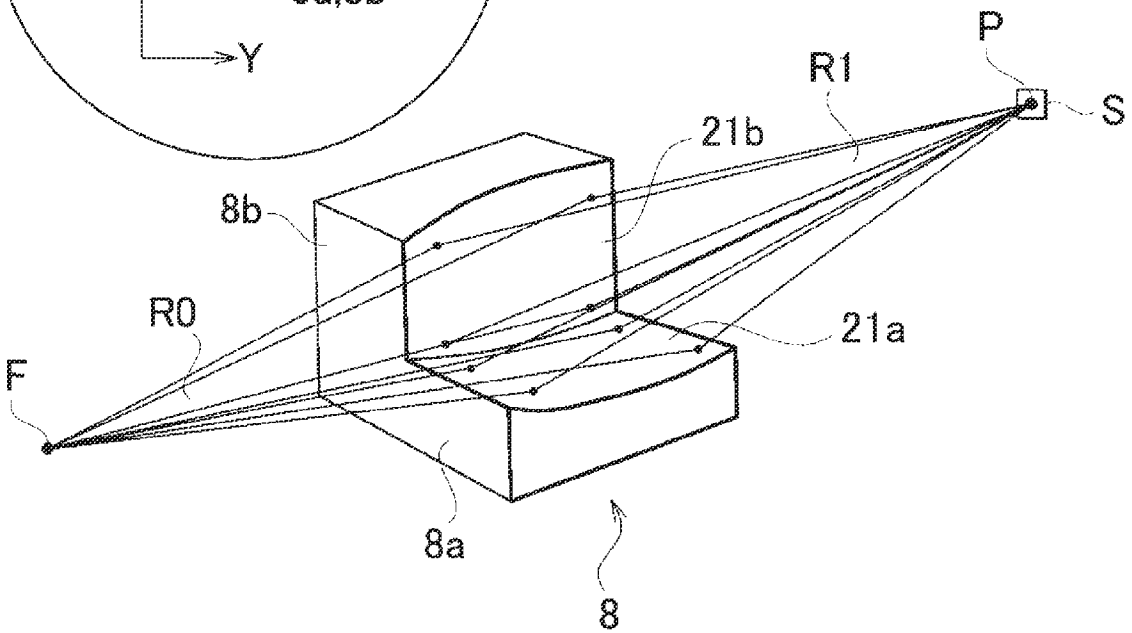
FIGS. 6 and 6A are perspective views showing a monochromator as another main part of the X-ray generator shown in FIG. 1.

The monochromator 8 of FIG. 1 monochromatizes X-rays which include X-rays of a plurality wavelength types that emanate from the X-ray focal point F. Specifically, the monochromator 8 selectively extracts X-rays of a specific wavelength from X-rays of a plurality of wavelength types. In the present embodiment, the monochromator 8 is composed of a multilayer mirror having a so-called side-by-side structure. A Max-Flux (registered trademark) manufactured by Rigaku Corporation, for example, can be used as the multilayer mirror. As shown in FIG. 6, the side-by-side multilayer mirror is configured such that two multilayer mirrors 8*a*, 8*b* having curved X-ray reflection surfaces 21*a*, 21*b*, respectively, are disposed at right angles to each other, for example.

Figure 6A:
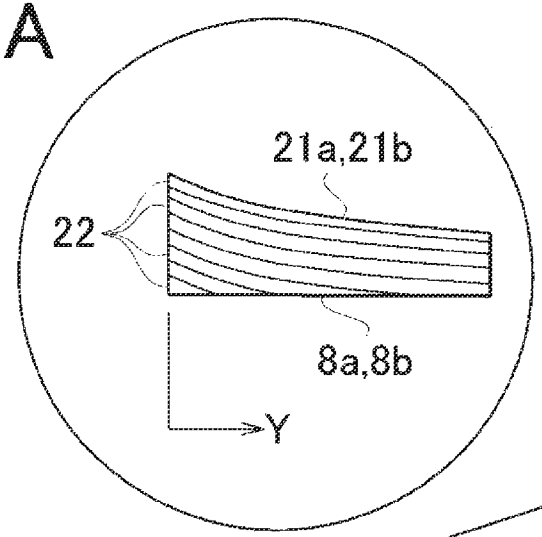

As shown schematically in the partial view 6A of FIG. 6, the multilayer mirrors 8*a*, 8*b* are formed by laminating thin films 22 composed of a plurality of different materials in alternating fashion. Various combinations of materials, such as Ni (nickel) and C (carbon), Mo (molybdenum) and Si (silicon), W (tungsten) and $B_4C$, for example, can be laminated. In FIG. 6A, the thin films 22 are shown extremely thick for the sake of convenience, but the actual thin films 22 are extremely thin. The X-rays R0 emitted from the X-ray focal point F are reflected (i.e., diffracted) by the X-ray reflection surfaces 21*a*, 21*b*. The reflected X-rays R1 follow a progression path corresponding to the curved shape of the X-ray reflection surfaces 21*a*, 21*b*.

For example, when the X-ray reflection surfaces 21*a*, 21*b* are elliptical and the X-ray focal point F is placed at one elliptical focus, the reflected X-rays R1 are convergent X-rays that converge at the other elliptical focus. When the X-ray reflection surfaces 21*a*, 21*b* are parabolic, the reflected X-rays R1 are parallel X-rays. In the present embodiment, the X-ray reflection surfaces 21*a*, 21*b* are elliptical and set so that the reflected X-rays R1 converge at a position P at which a sample S is placed.

X-rays generally are diffracted when the Bragg diffraction condition $2d \sin \theta = n\lambda$ is satisfied. In the equation, "d" is the distance between lattice planes, "θ" is the Bragg angle (i.e., the incidence angle and reflection angle of X-rays), "n" is the order of reflection, and "λ" is the wavelength of X-rays used. The multilayer mirrors 8*a*, 8*b* are designed so that when the distance from the side of X-ray incidence is designated as Y, the value of d varies each time the value of Y varies, and X-rays are reflected (i.e., diffracted) in each position at the distance Y. High-intensity X-rays are thereby obtained as the reflected X-rays R1.

In FIG. 1, the X-ray shutter 7 provided between the X-ray extraction window 6 of the casing 2 and the monochromator 8 as the X-ray conditioning element is formed in a cylindrical shape extending in the direction perpendicular to the paper surface (i.e., the direction through the paper surface) of FIG. 1, and is further provided with a through hole for passing X-rays in a direction that crosses the center line of the cylindrical shape. X-rays can be passed or the progress thereof blocked by aligning or not aligning the through hole with the X-ray progression path by rotating the X-ray shutter 7 about the center line thereof as indicated by the arrow C.

Since the X-ray generator 1 of the present embodiment is configured as described above, a vacuum state is set inside the casing 2 by the action of an exhaust system not shown in the drawings. The filament 11 generates heat when power is applied thereto, and releases thermo electrons. The released electrons impinge upon the outer circumferential surface of the rotating anode 4 to form an X-ray focal point F while the progression direction of the electrons is controlled by the Wehnelt electrode 12. X-rays radiate in all directions in space from this X-ray focal point F.

When the X-ray shutter 7 is set so as to allow the passage of X-rays, the X-rays R0 that pass through the X-ray shutter 7 are incident on the X-ray reflection surface of the monochromator 8. The monochromator 8 monochromatizes the incident X-rays, and the monochromatized X-rays R1 converge on a region within the sample S. The slit 9 prevents unnecessary X-rays from reaching the sample S. The X-rays incident on the sample S are diffracted according to the crystal structure of the sample S, and the diffracted X-rays are detected by an X-ray detector not shown in the drawings. The crystal structure of the sample S can be analyzed by analyzing the detection result.

The characteristics of the electron gun 3 gradually degrade over the course of X-ray generation. The electron gun 3 is replaced when the characteristics thereof degrade beyond an allowable limit. The need may also arise to replace the electron gun 3 with a different type of electron gun 3 according to the type of measurement. During such replacement of the electron gun 3, the cover 5 at the lateral end of the casing 2 is removed from the casing 2, a worker inserts a finger into the space K1 (referred to hereinafter as the pedestal housing space K1) in which the pedestal 20 is housed by the casing 2 and removes the attachment part 13 of the electron gun 3 from the pedestal 20, and takes the entire electron gun 3 out of the casing 2. The worker then inserts a different electron gun 3 into the pedestal housing space K1 and installs the electron gun 3 in a predetermined position with respect to the rotating anode 4 by fixing the attachment part 13 of the electron gun 3 to the pedestal 20.

In the present embodiment, the shape and dimensions relating to the casing 2 and other components are set in the following manner in FIG. 3. Each dimension shown is a rough value that includes an allowable error.

Figure 7:
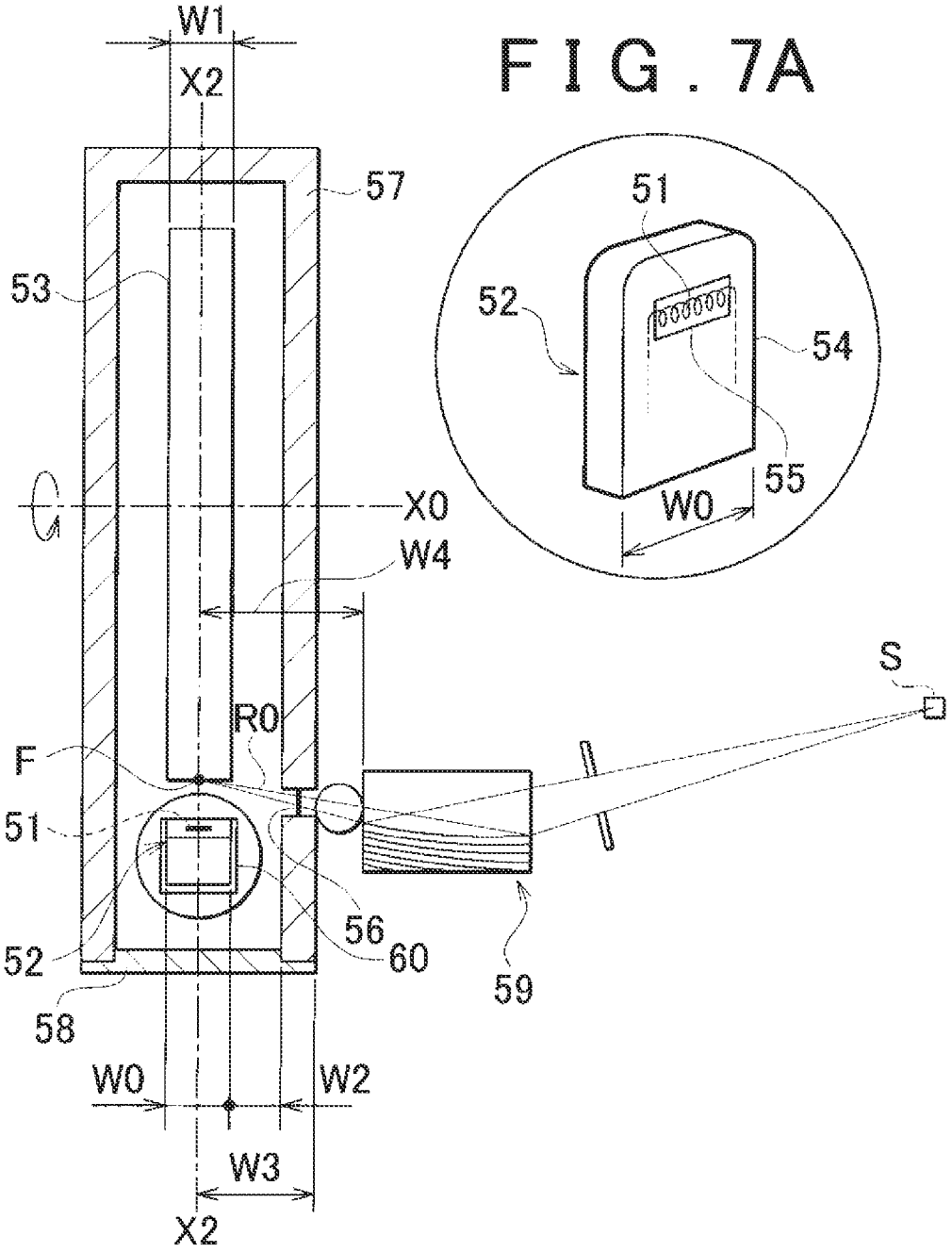
FIG. 7 PRIOR ART

- Width W10 of electron gun 3 (Wehnelt electrode 12): 10 mm
- Width W11 of rotating anode 4: 10 mm
- Distance W12 between the electron gun 3 (Wehnelt electrode 12) and the inside surface of the wall of the casing 2: 9.5 mm
- Distance W22 between the attachment part 13 of the electron gun 3 and the inside surface of the wall of the casing 2: 15 mm
- Distance W14 between the center line X2 extending in the plane-parallel direction of the rotating anode 4 and a distal end of the monochromator 8 X-ray conditioning element: 30 mm As described above, the distance W22 between the attachment part 13 of the electron gun 3 and the inside surface of the wall of the casing 2 is set to approximately 15 mm. This distance corresponds to the approximately 15 mm distance W2 between the electron gun 52 and the inside surface of the wall of the casing 57 in the conventional device shown in FIG. 7. These dimensions allow a worker to take the electron gun 3 in and out of the pedestal housing space K1 of the casing 2 without impediment.

In the present embodiment, the width W11 of the rotating anode 4 and the width W10 of the Wehnelt electrode 12 of the electron gun 3 are set smaller than the conventional technique. Accordingly, the width W32 of the space K2 (hereinafter referred to as the anticathode housing space K2) in which the rotating anode 4 is housed by the casing 2 is set smaller than the width W31 of the pedestal housing space K1 of the casing 2. With regard to the electron gun 3, the width W30 of the attachment part 13 is set so as to be substantially equal to the width of the conventional electron gun, and the width W10 of the Wehnelt electrode 12 (i.e., the main portion of the electron gun 3) that extends from the attachment part 13 is smaller than the width W30 of the attachment part 13. In the state in which the attachment part 13 of the electron gun 3 is attached to the pedestal 20, the Wehnelt electrode 12 formed with a narrow width as described above extends into the anticathode housing space K2 of the casing 2.

The aperture of the pedestal housing space K1 blocked by the cover 5 is provided in a plane of the pedestal housing space K1 on the opposite side from the anticathode housing space K2. The electron gun 3 can thereby be easily attached and detached via the aperture.

Due to the narrow width W32 of the anticathode housing space K2 of the casing 2 as described above, the distance W40 from the center line X2 of the plane-parallel direction (direction orthogonal to the width direction) of the rotating anode 4 to the X-ray extraction window 6 is less than the distance W41 from the center line X2 to the inside surface of the casing 2 in which the pedestal housing space K1 is formed. As a result, the distance W14 from the center line X2 extending in the plane-parallel direction of the rotating anode 4 to the distal end of the monochromator 8 is significantly reduced relative to the distance W4 that is the corresponding distance in the conventional X-ray generator shown in FIG. 7. For example, whereas the distance W4 at which the X-ray conditioning element 59 is disposed in the conventional technique is approximately 60 mm, the distance W14 at which the monochromator 8 is disposed in the present embodiment is approximately 30 mm.

Having a small distance W14 from the center line X2 extending in the plane-parallel direction of the rotating anode 4 to the distal end of the monochromator 8 means that a large capture angle β can be obtained for the X-rays R0 emitted from the X-ray focal point F that are captured by the monochromator 8, and that a large amount of X-rays can be captured by the monochromator 8. As a result, the X-ray focusing efficiency can be enhanced.

The X-ray shutter 7 in the present embodiment is provided in a position upstream (i.e., on the left side in FIG. 3) from the monochromator 8 in the X-ray progression direction, but the X-ray shutter 7 may also be provided in a position downstream (on the right side in FIG. 3) from the monochromator 8. The distance from the X-ray focal point F to the monochromator 8 can thereby be further reduced.

(Second Embodiment of the X-ray Generator)

Figure 8:
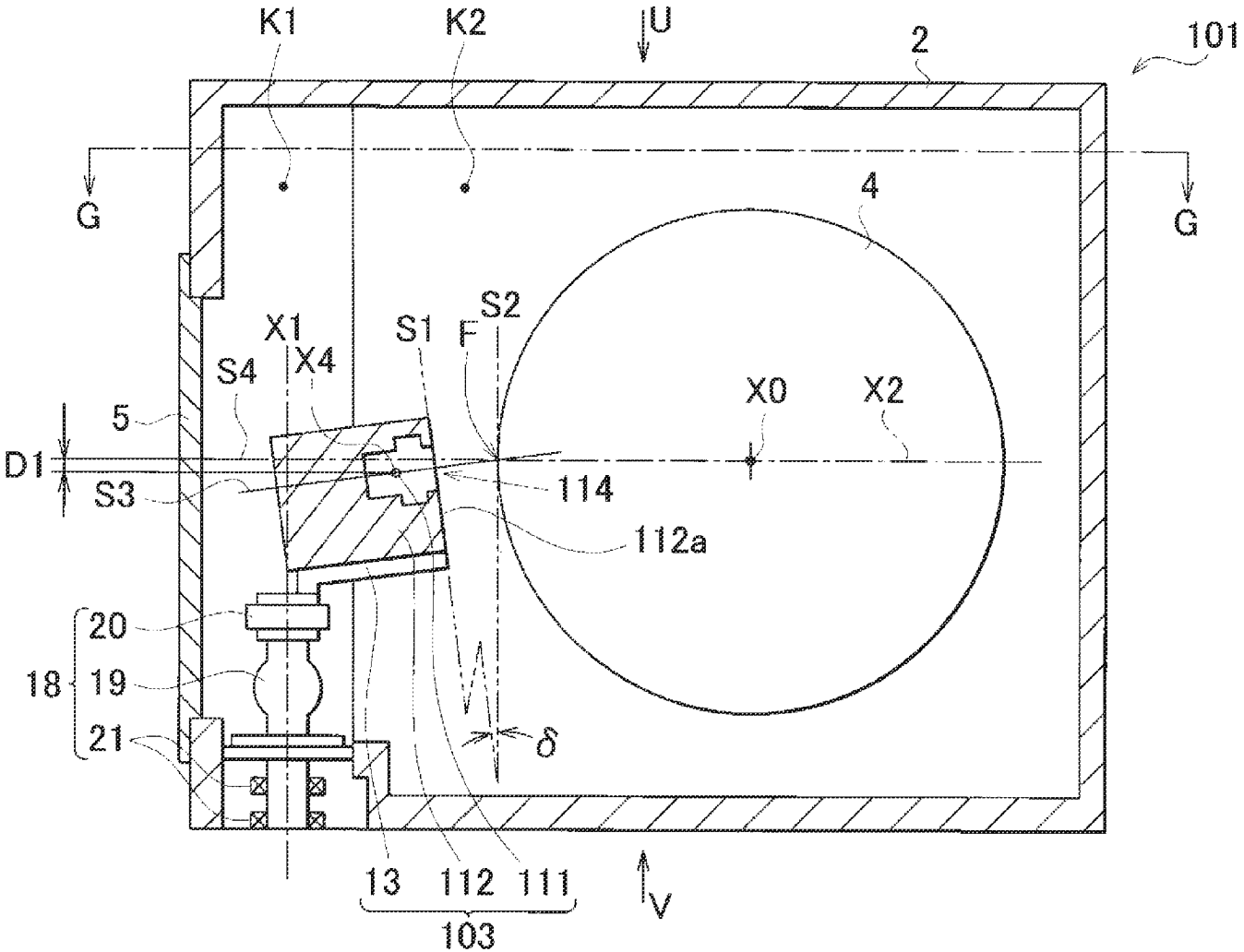
FIG. 8 is a sectional side view showing another embodiment of the X-ray generator according to the present invention.

FIG. 8 shows another embodiment of the X-ray generator of the present invention. FIG. 8 is a sectional side view showing the X-ray generator. The sectional plan view along line G-G of this X-ray generator is the same as FIG. 1. Members in the present embodiment that are the same as in the embodiment shown in FIGS. 1 and 2 are indicated by the same reference symbols.

Figure 9:
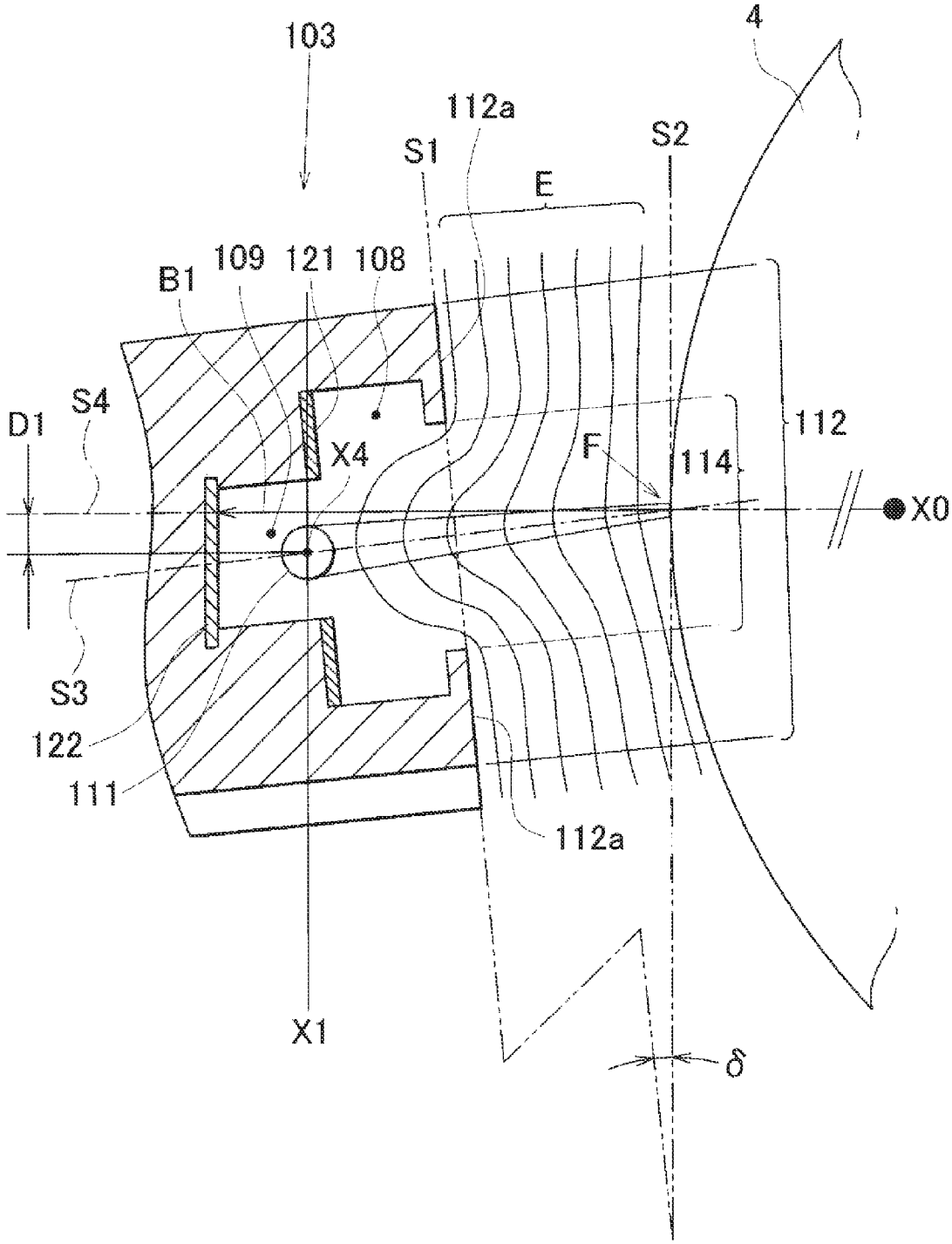
FIG. 9 is an enlarged partial cut-away side view showing the electron gun as a main part shown in FIG. 8.
Figure 10:
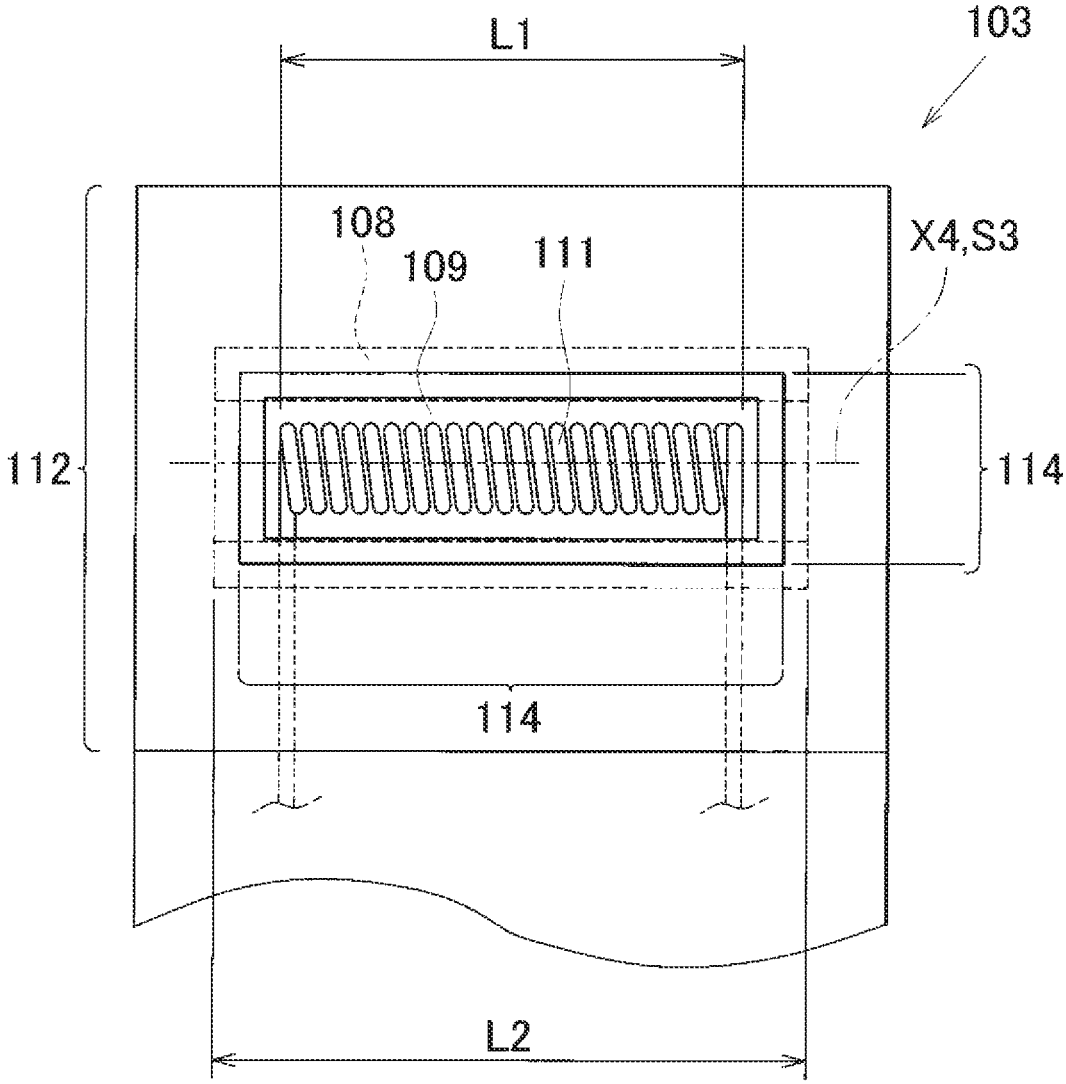
FIG. 10 is a front view showing the electron gun of FIG. 9.

In the X-ray generator 101 of the present embodiment, an electron gun 103 has a Wehnelt electrode 112 formed of a conductive metal, and a filament 111 as a cathode is housed by a space formed inside the Wehnelt electrode 112. The filament 111 is formed of a coiled metal wire of length L1, as shown in FIG. 10. In FIG. 9, the filament 111 extends in the direction at a right angle to the paper surface (i.e., the direction through the paper surface). The Wehnelt electrode 112 is an electrode for controlling the progression direction of electrons by applying an electric field to the electrons released from the filament 111, according to a publicly known technique.

The internal space of the Wehnelt electrode 112 is composed of a first space 108 having a large volume and a second space 109 having a small volume. As is apparent from FIG. 10, the first space 108 and the second space 109 are cube shapes elongated in the left-right direction (horizontal direction), and the lengths L2 thereof in the left-right direction are the same. As shown in FIG. 9, the second space 109 is positioned to the rear of the first space 108 as viewed from the rotating anode 4, and is connected to the first space 108. A portion of the portion of the filament 111 that is ring-shaped in cross-section is in the first space 108, and the remainder of the filament 111 is in the second space 109. However, the positioning of the filament 111 is not thus limited.

A first X-ray blocking member 121 is detachably attached to a wall of the first space 108 at the boundary portion between the first space 108 and the second space 109. A second X-ray blocking member 122 is detachably attached at the rear of the second space 109. The first X-ray blocking member 121 is formed of Mo (molybdenum), for example. The second X-ray blocking member 122 is formed of W (tungsten), for example.

In FIG. 9, a distal end surface 112*a* of the Wehnelt electrode 112 is significantly involved in forming an electric field E. In the present specification, the surface 112*a* is referred to as a field formation surface of the Wehnelt electrode 112. The surface 112*a* is included in a single flat plane S1. In the present specification, this plane S1 is referred to as a Wehnelt plane S1.

The field formation surface 112*a* of the Wehnelt electrode 112 forms the boundary of an aperture 114 for passing electrons that are generated from the filament 111. Electrons pass through the aperture 114 and progress onward. In the present embodiment, the field formation surface 112*a* of the Wehnelt electrode 112, and thus the Wehnelt plane S1, is inclined at an angle δ with respect to the plane (referred to hereinafter as the tangent plane) S2 that includes a line tangent to the outer circumferential surface of the rotating anode 4 about the X-ray focal point F on the outer circumferential surface of the rotating anode 4. The angle δ is 3°, for example. The center line X4 of the coil ring of the filament 111 passes through the center of the aperture 114 for electron release into the plane S3 orthogonal to the field formation surface 112*a*, and thus to the Wehnelt plane S1.

Since the center line X4 of the filament 111 is provided in the center plane S3 of the Wehnelt aperture 114, the energy received from the electric field E by the electrons emitted from the filament 111 is always uniform, and the electrons therefore progress linearly without curving, and form the X-ray focal point F on the outer circumferential surface of the rotating anode 4.

Since the Wehnelt plane S1 that includes the aperture 114, and the tangent plane S2 through the X-ray focal point F are inclined at the angle δ, the center line X4 of the filament 111 is in a position that is offset a distance D1 with respect to the plane (horizontal plane in the present embodiment) S4 through the rotational center line X0 of the rotating anode 4 and the center line of the X-ray focal point F. The plane S4 through the rotational center line X0 of the rotating anode 4 and the center line of the X-ray focal point F is the plane orthogonal to the tangent plane S2 of the outer circumferential surface of the rotating anode 4 at the X-ray focal point F, i.e., the normal plane.

As previously mentioned, the electrons emitted from the filament 111 form the X-ray focal point F on the outer circumferential surface of the rotating anode 4, X-rays radiate from the X-ray focal point F, but in this radiation of X-rays, positive ions generally are released as indicated by the arrow B1 along the direction normal to the outer circumferential surface of the rotating anode 4 from the X-ray focal point F. In the event that the positive ions impinge upon the filament 111, problems arise in that degradation of the filament 111 is accelerated and the service life of the filament 111 is reduced.

In the present embodiment, however, since the filament 111 is offset a distance D1 from the normal plane S4 of the rotating anode 4, positive ions pass through the surrounding second space 109 without colliding with the filament 111, and collide with and are absorbed by the second X-ray blocking member 122. A reduction in service life of the filament 111 due to impingement of positive ion can thereby be prevented, and the characteristics of the filament 111 can be maintained for a long time. When the second X-ray blocking member 122 is degraded by prolonged impingement of positive ions, the second X-ray blocking member 122 may be replaced with another second X-ray blocking member 122.

A configuration may also be adopted whereby positive ions collide with the first X-ray blocking member 121 instead of the second X-ray blocking member 122.

In the X-ray generator disclosed in Patent Citation 2 (Japanese Laid-open Patent Publication No. 2007-115553), a configuration is adopted in which the filament, i.e., the cathode, is offset an appropriate distance from the center position of the Wehnelt electrode, whereby the progression direction of the electron beam is bent to form an X-ray focal point on the outer circumferential surface of the rotating anode, and positive ions emitted in the direction normal to the rotating anode from the X-ray focal point thereby do not collide with the cathode. In this case, however, the position in which to place the cathode is extremely difficult to determine in design, and the adjustment for precisely positioning the cathode is also extremely difficult to perform.

In the present embodiment, however, since the filament 111 need only be disposed in the center position of the Wehnelt electrode 112, design is extremely simple, and the filament 111 is also extremely simple to install.

In the present embodiment as well, the shape and dimensions of the casing 2 are set so as to be the same as in the embodiment shown in FIG. 1. Specifically, as shown in FIGS. 1 and 8, the X-ray generator 101 of the present embodiment is an X-ray generator 101 for generating X-rays from an X-ray focal point F which is a region in which electrons emitted from the filament 111 as the cathode impinge upon the anticathode 4, and the X-ray generator has a Wehnelt electrode 112 for surrounding the filament 111; an attachment part 13 formed integrally with the Wehnelt electrode 112; a pedestal 20 to which the attachment part 13 is attached; and a casing 2 for housing the pedestal 20 and the anticathode 4. The width W32 of the space K2 in which the anticathode 4 is housed by the casing 2 is less than the width W31 of the space K1 in which the pedestal 20 is housed by the casing 2. The Wehnelt electrode 112 extends into the space K2 in which the anticathode 4 is housed by the casing 2, in a state in which the attachment part 13 is attached to the pedestal 20.

Since the width W32 of the space K2 in which the anticathode 4 is housed by the casing 2 is less than the width W31 of the space K1 in which the pedestal 20 is housed by the casing 2, the width W31 of the pedestal housing space K1 can be made less than the width W32 of the anticathode housing space K2 even in a case in which the width W31 of the pedestal housing space K1 is set relatively large so as to pose no impediment to manual replacement of the electron gun 103.

By reducing the width W32 of the anticathode housing space K2 of the casing 2 in this manner, in a case in which an X-ray conditioning element (e.g., the monochromator 8 (refer to FIG. 3)) is disposed outside the casing 2, it is possible to reduce the distance from a center line X2 (i.e., the center line of the anticathode 4 passing through the X-ray focal point F) in the plane-parallel direction of the anticathode 4 to the monochromator 8. Reducing the distance from the X-ray focal point F to the monochromator 8 makes it possible to increase the range of capture angles β of X-rays emitted from the X-ray focal point F that are captured by the monochromator 8, and the range of capture lengths of X-rays that correspond to the capture angles β, and the efficiency of X-ray focusing by the monochromator 8 can therefore be increased.

Furthermore, since the distance from the X-ray focal point F to the monochromator 8 is reduced, attenuation of the intensity of X-rays due to air scattering can also be suppressed.

(Other Embodiments)

The present invention is described above using preferred embodiments, but the present invention is not limited by these embodiments and can be modified in various ways within the scope of the invention as recited in the claims.

For example, the cathode is not limited to a helical filament 11 such as the one shown in FIG. 4, and may be an electron generating material in the shape of a solid having a rectangular cross-sectional shape and a predetermined length. In this case, a boride such as $LaB_6$ (lanthanum hexaboride) or the like may be used as the material.

A configuration is adopted in the above embodiments in which the electron gun 3 can be tilted (i.e., pivoted) about the center line X1 thereof in FIG. 3, but the present invention also encompasses a configuration in which the electron gun 3 is fixed in a state of always extending parallel to the center line X2 that extends in the plane-parallel direction of the rotating anode 4 rather than being tilted as described above.

The rotating anode 4 is also used as the anticathode in the embodiments described above, but a fixed-type anticathode may also be used.

What is claimed is:

1. An X-ray generator for generating X-rays from an X-ray focal point, said X-ray focal point being a region in which electrons emitted from a cathode impinge upon an anticathode; said X-ray generator comprising:

a Wehnelt electrode for surrounding said cathode;

an attachment part formed integrally with said Wehnelt electrode;

a pedestal to which said attachment part is attached; and a casing for housing said pedestal and said anticathode; wherein the width of an anticathode housing space in which said anticathode is housed by said casing is less than the width of a pedestal housing space in which said pedestal is housed by said casing; and said Wehnelt electrode extends into a space in which said anticathode is housed by said casing, in a state in which said attachment part is attached to said pedestal.

2. The X-ray generator according to claim 1, wherein the width of said Wehnelt electrode is less than the width of said attachment part.

3. The X-ray generator according to claim 1, comprising:

an X-ray extraction window provided to the casing for housing said anticathode; wherein the distance from a center line in the plane-parallel direction of said anticathode to said X-ray extraction window is less than the distance from the center line in the plane-parallel direction of said anticathode to an inside surface of a portion of the casing that houses said pedestal.

4. The X-ray generator according to claim 3, further comprising:

an X-ray conditioning element for receiving X-rays emitted from said X-ray focal point, the X-ray conditioning element being provided outside said X-ray extraction window; wherein said X-ray extraction window has an irradiation angle larger than the range of angles at which X-rays generated from said X-ray focal point are captured by said X-ray conditioning element.

5. The X-ray generator according to claim 1, wherein a plane of said pedestal housing space opposite said anticathode housing space is an aperture;

the aperture is sufficiently large to enable the Wehnelt electrode and the attachment part integrated therewith to pass through; and the aperture is blocked by a removable cover.

6. The X-ray generator according to claim 2, comprising:

an X-ray extraction window provided to the casing for housing said anticathode; wherein the distance from a center line in the plane-parallel direction of said anticathode to said X-ray extraction window is less than the distance from the center line in the plane-parallel direction of said anticathode to an inside surface of a portion of the casing that houses said pedestal.

7. The X-ray generator according to claim 6, further comprising:

an X-ray conditioning element for receiving X-rays emitted from said X-ray focal point, the X-ray conditioning element being provided outside said X-ray extraction window; wherein said X-ray extraction window has an irradiation angle larger than the range of angles at which X-rays generated from said X-ray focal point are captured by said X-ray conditioning element.

8. The X-ray generator according to claim 7, wherein a plane of said pedestal housing space opposite said anticathode housing space is an aperture;

the aperture is sufficiently large to enable the Wehnelt electrode and the attachment part integrated therewith to pass through; and the aperture is blocked by a removable cover.

* * * * *